US010218075B1

(12) United States Patent
Smith

(10) Patent No.: US 10,218,075 B1
(45) **Date of Patent: *Feb. 26, 2019**

(54) DUAL OPEN-ENDED WAVEGUIDE ANTENNA FOR AUTOMOTIVE RADAR

(71) Applicant: Waymo LLC, Mountain View, CA (US)

(72) Inventor: Russell Leigh Smith, Santa Clara, CA (US)

(73) Assignee: Waymo LLC, Mountain View, CA (US)

( * ) Notice: Subject to any disclaimer, the term of this patent is extended or adjusted under 35 U.S.C. 154(b) by 234 days.

This patent is subject to a terminal disclaimer.

(21) Appl. No.: 15/266,777

(22) Filed: Sep. 15, 2016

Related U.S. Application Data

(63) Continuation of application No. 14/229,597, filed on Mar. 28, 2014, now Pat. No. 9,472,853.

(51) Int. Cl.
*H01Q 13/00* (2006.01)
*H01Q 13/02* (2006.01)
*H01Q 1/32* (2006.01)

(52) U.S. Cl.
CPC ..... *H01Q 13/0216* (2013.01); *H01Q 1/3275* (2013.01)

(58) Field of Classification Search
CPC ..... H01Q 1/3275; H01Q 13/0216
See application file for complete search history.

(56) References Cited

U.S. PATENT DOCUMENTS

| | | | | |
|---|---|---|---|---|
| 5,380,386 | A * | 1/1995 | Oldham | H01P 11/00 156/150 |
| 5,929,728 | A | 7/1999 | Barnett et al. | |
| 6,861,996 | B2 | 3/2005 | Jeong | |
| 7,817,097 | B2 * | 10/2010 | Margomenos | B29C 59/02 343/772 |
| 8,587,492 | B2 | 11/2013 | Runyon | |
| 2004/0090290 | A1 * | 5/2004 | Teshirogi | H01Q 13/22 333/237 |
| 2010/0060537 | A1 * | 3/2010 | Nagayama | H01Q 1/247 343/776 |

(Continued)

*Primary Examiner* — Jessica Han
*Assistant Examiner* — Jae Kim
(74) *Attorney, Agent, or Firm* — McDonnell Boehnen Hulbert & Berghoff LLP

(57) ABSTRACT

An example method may involve forming, in a first metal layer, a first half of waveguide channels including an input waveguide channel, a plurality of wave-dividing channels, and a plurality of wave-radiating channels. The input waveguide channel may include an input port for receiving electromagnetic waves into the waveguide channels, and the first half of the plurality of wave-radiating channels may include wave-directing members configured to propagate sub-portions of waves from the first metal layer to another metal layer. The method may also involve forming, in a second metal layer, a second half of the waveguide channels. The second half of the wave-radiating channels may include pairs of output ports configured to radiate the sub-portions of waves out of the second metal layer. The method may further involve fastening the first metal layer to the second metal layer so as to substantially align the halves of the waveguide channels.

20 Claims, 11 Drawing Sheets

(56) References Cited

U.S. PATENT DOCUMENTS

| | | | | |
|---|---|---|---|---|
| 2011/0187614 | A1* | 8/2011 | Kirino ..... | G01S 7/032<br>343/713 |
| 2012/0068900 | A1 | 3/2012 | Yatabe et al. | |
| 2012/0092224 | A1 | 4/2012 | Sauleau et al. | |

* cited by examiner

DUAL OPEN-ENDED WAVEGUIDE ANTENNA FOR AUTOMOTIVE RADAR

CROSS-REFERENCE TO RELATED APPLICATION

The present disclosure is a continuation of U.S. patent application Ser. No. 14/229,597, filed on Mar. 28, 2014, and entitled "Dual Open-Ended Waveguide Antenna for Automotive Radar," the entire contents of which are herein incorporated by reference as if fully set forth in this description.

BACKGROUND

Unless otherwise indicated herein, the materials described in this section are not prior art to the claims in this application and are not admitted to be prior art by inclusion in this section.

Radio detection and ranging (RADAR) systems can be used to actively estimate distances to environmental features by emitting radio signals and detecting returning reflected signals. Distances to radio-reflective features can be determined according to the time delay between transmission and reception. The radar system can emit a signal that varies in frequency over time, such as a signal with a time-varying frequency ramp, and then relate the difference in frequency between the emitted signal and the reflected signal to a range estimate. Some systems may also estimate relative motion of reflective objects based on Doppler frequency shifts in the received reflected signals. Directional antennas can be used for the transmission and/or reception of signals to associate each range estimate with a bearing. More generally, directional antennas can also be used to focus radiated energy on a given field of view of interest. Combining the measured distances and the directional information allows for the surrounding environment features to be mapped. The radar sensor can thus be used, for instance, by an autonomous vehicle control system to avoid obstacles indicated by the sensor information.

Some example automotive radar systems may be configured to operate at an electromagnetic wave frequency of 77 Giga-Hertz (GHz), which corresponds to millimeter (mm) electromagnetic wave length (e.g., 3.9 mm for 77 GHz). These radar systems may need antennas that can to focus the radiated energy into tight beams in order to enable the radar system to measure an environment with high accuracy, such as an environment around an autonomous vehicle. Such antennas may be compact (typically with rectangular form factors; e.g., 1.3 inches high by 2.5 inches wide), efficient (i.e., there should be little 77 GHz energy lost to heat in the antenna, or reflected back into the transmitter electronics), and cheap and easy to manufacture, since radar systems with these antennas are made in high volume.

In some scenarios, efficiency may be difficult to balance with cheap and easy manufacture. Some cheap and easy to manufacture options may involve integrating an antenna into a circuit board (e.g., with a "series-fed patch array"), which is used by many off-the-shelf automotive radars. However, such antennas may lose much of their energy into heating up the substrate of the circuit board. Antennas with the lowest loss may include all-metal designs, but typical all-metal antennas, such as slotted waveguide arrays, can be difficult to manufacture with the small geometries needed to support 77 GHz operation.

SUMMARY

The present application discloses embodiments that relate to a dual open-ended waveguide (DOEWG) antenna. In one aspect, the present application describes an apparatus for a DOEWG antenna. The apparatus may include a first metal layer including a first half of one or more waveguide channels, where respective portions of the first half of the one or more waveguide channels include an elongated segment and, at a first end of the elongated segment, at least one wave-directing member configured to propagate at least a portion of electromagnetic waves to another metal layer, and where the first metal layer further includes a through-hole at a second end of a given elongated segment opposite the first end configured to receive electromagnetic waves into the one or more waveguide channels. The apparatus may also include a second metal layer joined to the first metal layer, the second metal layer including a second half of the one or more waveguide channels and joined to the first metal layer to align the first half of the one or more waveguide channels with the second half of the one or more waveguide channels to form the one or more waveguide channels, where respective portions of the second half of the one or more waveguide channels include an elongated segment substantially aligned with the elongated segment of the first half of the one or more waveguide channels and, at an end of the elongated segment, at least one pair of through-holes partially aligned with the at least one wave-directing member and configured to radiate electromagnetic waves propagated from the at least one wave-directing member out of the second metal layer.

In another aspect, the present application describes a method. The method may involve forming, in a first metal layer, a first half of one or more waveguide channels, where respective portions of the first half of the one or more waveguide channels include an elongated segment and, at a first end of the elongated segment, at least one wave-directing member configured to propagate at least a portion of electromagnetic waves to another metal layer. The method may further involve forming, in the first metal layer, a through-hole at a second end of a given elongated segment opposite the first end, where the through-hole is configured to receive electromagnetic waves into the one or more waveguide channels. The method may still further involve forming, in a second metal layer, a second half of the one or more waveguide channels, where respective portions of the second half of the one or more waveguide channels include an elongated segment substantially aligned with the elongated segment of the first half of the one or more waveguide channels and, at an end of the elongated segment, at least one pair of through-holes partially aligned with the at least one wave-directing member and configured to radiate electromagnetic waves propagated from the at least one wave-directing member out of the second metal layer. The method may yet still further involve providing at least one fastener configured to join the first metal layer to the second metal layer so as to align the first half of the one or more waveguide channels with the second half of the one or more waveguide channels to form the one or more waveguide channels.

In yet another aspect, the present application describes an apparatus. The apparatus may include a first metal layer and a second metal layer. The first metal layer may include (i) a first half of an input waveguide channel, where the first half of the first waveguide channel includes an input port configured to receive electromagnetic waves into the first waveguide channel, (ii) a first half of a plurality of wave-dividing channels, where the plurality of wave-dividing channels are configured to receive the electromagnetic waves from the input waveguide channel, divide the electromagnetic waves into a plurality of portions of electromagnetic waves, and propagate respective portions of electromagnetic waves to respective wave-radiating channels of a plurality of wave-radiating channels, and (iii) a first half of the plurality of wave-radiating channels, where respective wave-radiating channels are configured to receive the respective portions of electromagnetic waves from the wave-dividing channels, and where first halves of the respective wave-radiating channels include at least one wave-directing member configured to propagate sub-portions of electromagnetic waves to the second metal layer. The second metal layer may include (i) a second half of the input waveguide channel, (ii) a second half of the plurality of wave-dividing channels, and (iii) a second half of the plurality of wave-radiating channels, where second halves of the respective wave-radiating channels include at least one pair of output ports partially aligned with the at least one wave-directing member and configured to radiate the sub-portions of electromagnetic waves propagated from the at least one wave-directing member out of the second metal layer.

In still another aspect, a system is provided that includes a means for forming, in a first metal layer, a first half of one or more waveguide channels, where respective portions of the first half of the one or more waveguide channels include an elongated segment and, at a first end of the elongated segment, at least one wave-directing member configured to propagate at least a portion of electromagnetic waves to another metal layer. The system further includes a means for forming, in the first metal layer, a through-hole at a second end of a given elongated segment opposite the first end, where the through-hole is configured to receive electromagnetic waves into the one or more waveguide channels. The system further includes a means for forming, in a second metal layer, a second half of the one or more waveguide channels, where respective portions of the second half of the one or more waveguide channels include an elongated segment substantially aligned with the elongated segment of the first half of the one or more waveguide channels and, at an end of the elongated segment, at least one pair of through-holes partially aligned with the at least one wave-directing member and configured to radiate electromagnetic waves propagated from the at least one wave-directing member out of the second metal layer. The system further includes a means for providing at least one fastener configured to join the first metal layer to the second metal layer so as to align the first half of the one or more waveguide channels with the second half of the one or more waveguide channels to form the one or more waveguide channels.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
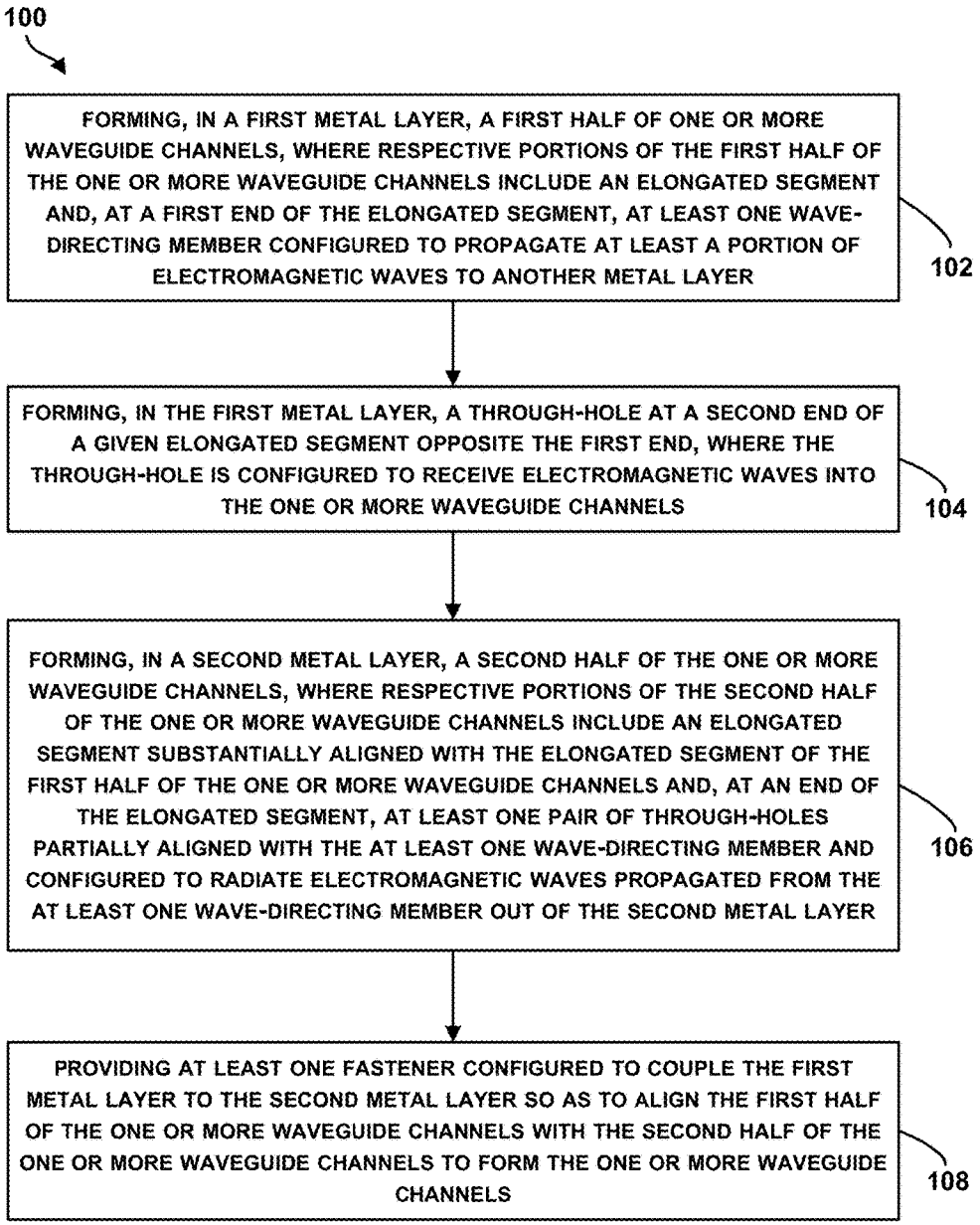
FIG. 1 is a flow chart of an example method to fabricate an antenna.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

The following detailed description may disclose, inter alia, an apparatus for a "dual open-ended waveguide" (DOEWG) antenna for a radar system for an autonomous vehicle, for instance, and a method for fabricating such an antenna. In some examples, the term "DOEWG" may refer herein to a short section of a horizontal waveguide channel plus a vertical channel that splits into two parts, where each of the two parts of the vertical channel includes an output port configured to radiate at least a portion of electromagnetic waves that enter the antenna.

An example DOEWG antenna may comprise, for example, two metal layers (e.g., aluminum plates) that can be machined with computer numerical control (CNC), aligned properly, and joined together. The first metal layer may include a first half of an input waveguide channel, where the first half of the first waveguide channel includes an input port that may be configured to receive electromagnetic waves (e.g., 77 GHz millimeter waves) into the first waveguide channel. The first metal layer may also include a first half of a plurality of wave-dividing channels. The plurality of wave-dividing channels may comprise a network of channels that branch out from the input waveguide channel and that may be configured to receive the electromagnetic waves from the input waveguide channel, divide the electromagnetic waves into a plurality of portions of electromagnetic waves (i.e., power dividers), and propagate respective portions of electromagnetic waves to respective wave-radiating channels of a plurality of wave-radiating channels.

Further, the first metal layer may include a first half of the plurality of wave-radiating channels, where respective wave-radiating channels may be configured to receive the respective portions of electromagnetic waves from the wave-dividing channels, and where first halves of the respective wave-radiating channels include at least one wave-directing member configured to propagate sub-portions of electromagnetic waves to another metal layer.

Moreover, the second metal layer may include second halves of the input waveguide channel, the plurality of wave-dividing channels, and the plurality of wave-radiating channels. The second halves of the respective wave-radiating channels may include at least one pair of output ports partially aligned with the at least one wave-directing member and configured to radiate the sub-portions of electromagnetic waves propagated from the at least one wave-directing member out of the second metal layer. More particularly, a combination of a given wave-directing member with a corresponding pair of output ports may take the form of (and may be referred to herein as) a DOEWG, as described above.

While in this particular example the antenna includes multiple wave-dividing channels and multiple wave-radiating channels, in other examples the antenna may include, at a minimum, only a single channel configured to propagate all the electromagnetic waves received by the input port to one or more wave-radiating channels. For instance, all the electromagnetic waves may be radiated out of the second metal layer by a single DOEWG. Other examples are possible as well.

Furthermore, while in this particular example, as well as in other examples described herein, the antenna apparatus may be comprised of two metal layers, it should be understood that in still other examples, one or more of the channels described above may be formed into a single metal layer, or into more than two metal layers that make up the antenna. Still further, within examples herein, the concept of electromagnetic waves (or portions/sub-portions thereof) propagating from one layer of a DOEWG antenna to another layer is described for the purpose of illustrating functions of certain components of the antenna, such as the wave-directing members. In reality, electromagnetic waves may not be confined to any particular "half" of a channel during certain points of their propagation through the antenna. Rather, at these certain points, the electromagnetic waves may propagate freely through both halves of a given channel when the halves are combined to form the given channel.

In some embodiments discussed herein, the two metal layers may be joined directly, without the use of adhesives, dielectrics, or other materials, and without methods such as soldering, diffusion bonding, etc. that can be used to join two metal layers.

Referring now to the figures, FIG. 1 is a flow chart of an example method 100 to fabricate a DOEWG antenna. It should be understood that other methods of fabrication not described herein are possible as well.

It should also be understood that a given application of such an antenna may determine appropriate dimensions and sizes for various machined portions of the two metal layers described above (e.g., channel size, metal layer thickness, etc.) and/or for other machined (or non-machined) portions/components of the antenna described herein. For instance, as discussed above, some example radar systems may be configured to operate at an electromagnetic wave frequency of 77 GHz, which corresponds to millimeter electromagnetic wave length. At this frequency, the channels, ports, etc. of an apparatus fabricated by way of method 100 may be of given dimensions appropriated for the 77 GHz frequency. Other example antennas and antenna applications are possible as well.

Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

Moreover, the method 100 of FIG. 1 will be described in conjunction with FIGS. 2A-2E.

Figure 2A:
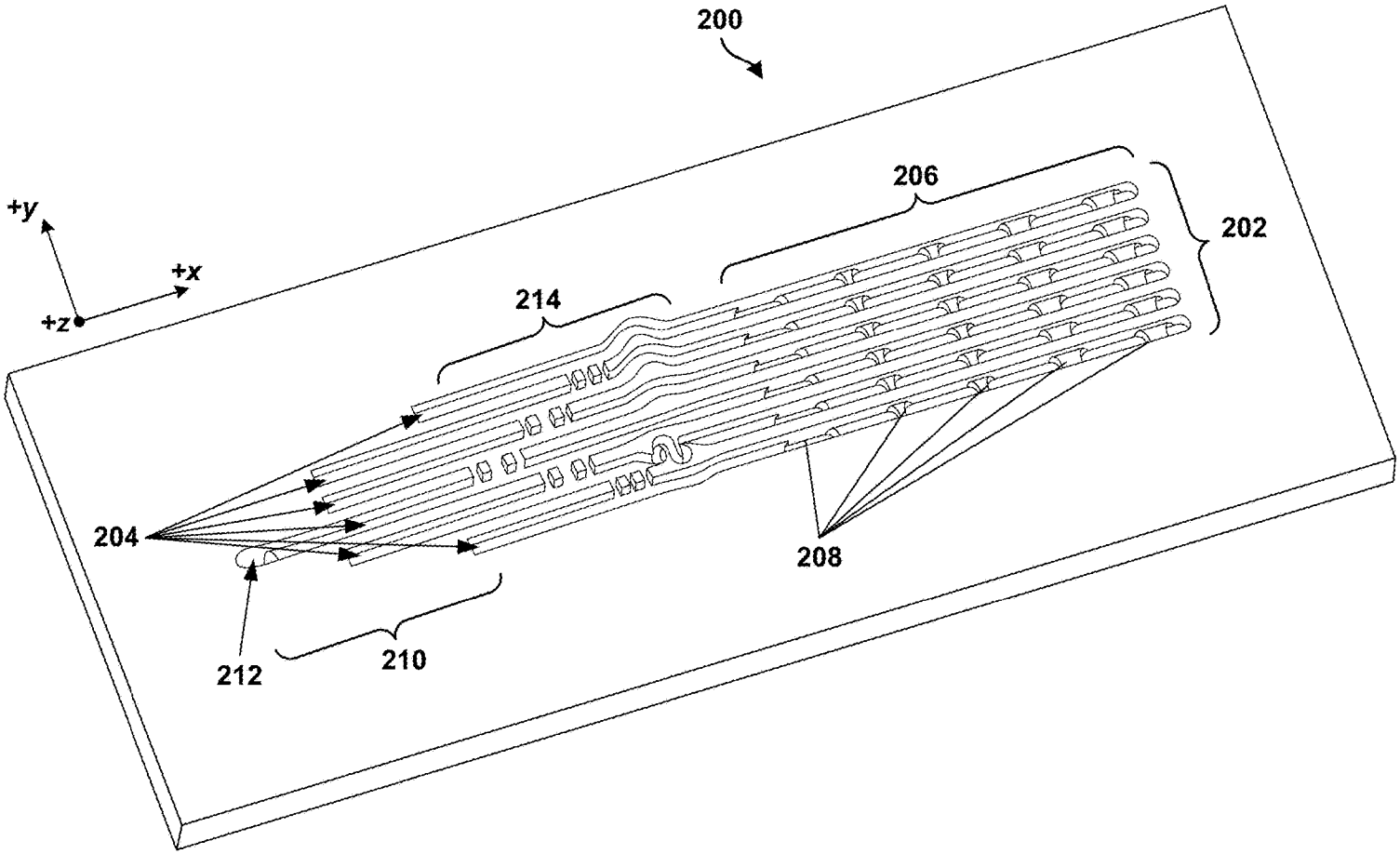
FIG. 2A illustrates a first layer of an example antenna, in accordance with an example embodiment.
Figure 2B:
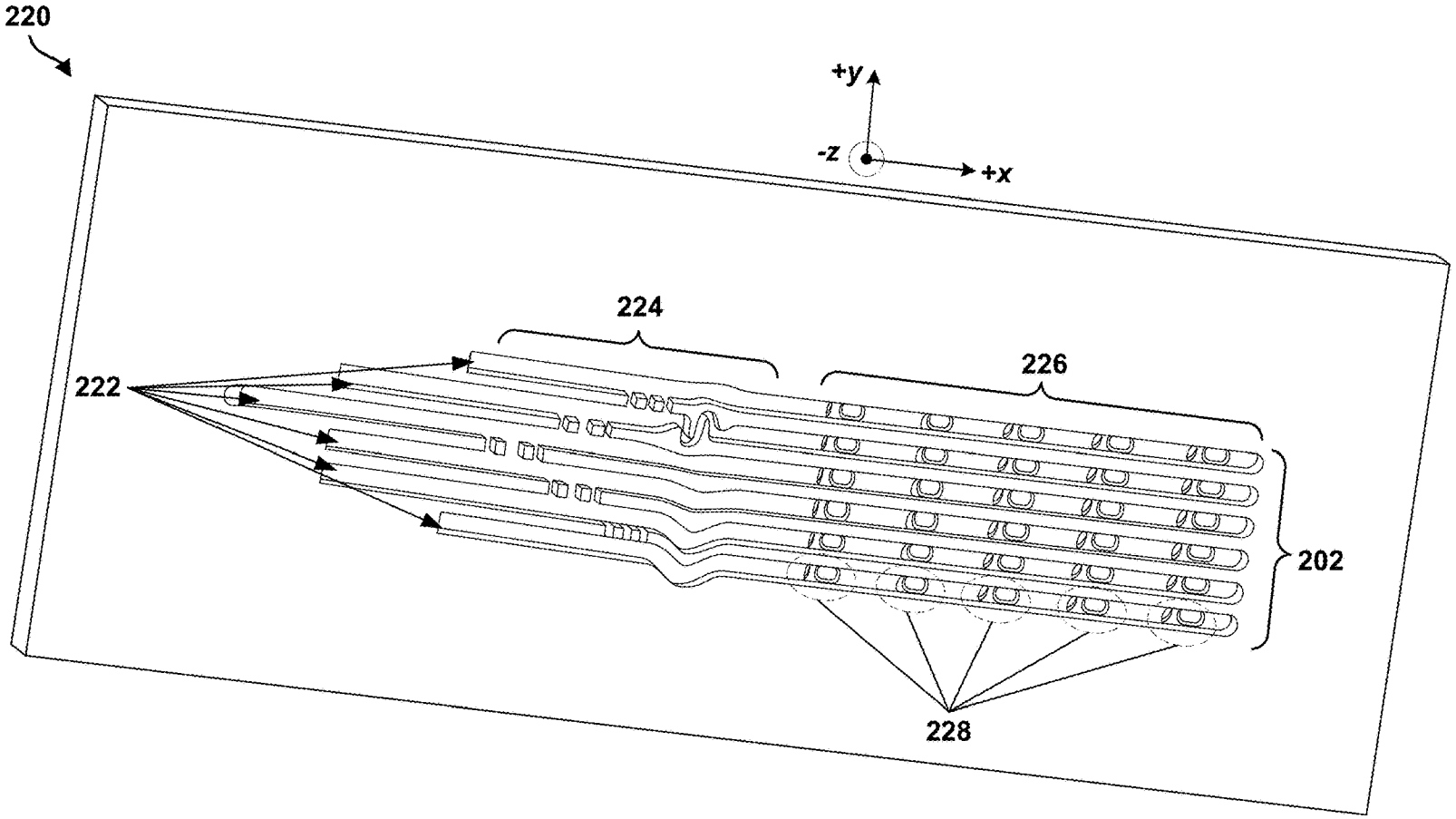
FIG. 2B illustrates a second layer of an example antenna, in accordance with an example embodiment.

At block 102, the method 100 includes forming, in a first metal layer, a first half of one or more waveguide channels, where respective portions of the first half of the one or more waveguide channels include an elongated segment and, at a first end of the elongated segment, at least one wave-directing member configured to propagate at least a portion of electromagnetic waves (e.g., 77 GHz millimeter electromagnetic waves) to another metal layer (e.g., the second metal layer, as shown in FIG. 2B).

At block 104, the method 100 includes forming, in the first metal layer, a through-hole at a second end of a given elongated segment opposite the first end, where the through-hole is configured to receive electromagnetic waves into the one or more waveguide channels.

FIG. 2A illustrates an example first metal layer 200 including a first half of a plurality of waveguide channels 202. These waveguide channels 202 may comprise multiple elongated segments 204. At a first end 206 of each elongated segment 204 may be a plurality of collinear wave-directing members 208, each with sizes similar or different from other wave-directing members. In line with the description above, the first ends 206 of the elongated segments 204 may be referred to herein as a first half of wave-radiating channels.

At a second end 210 of the channels 202 opposite the first end 206, one of the elongated segments 204 may include a through-hole 212 (i.e., input port). A given amount of power may be used to feel a corresponding amount of electromagnetic waves (i.e., energy) into the apparatus, and the through-hole 212 may be the location where these waves enter the apparatus. In line with the description above, the single channel/segment of the waveguide channels 202 that includes the input port may be referred to herein as an input waveguide channel.

Upon entering the apparatus, the electromagnetic waves may travel in the +x direction, as shown, towards an array of power dividers 210 (i.e., a "beam-forming network"). The array 210 may function to divide up the electromagnetic waves and propagate respective portions of the waves to respective first ends 206 of each elongated segment 204. More specifically, the waves may continue to propagate in the +x direction after leaving the array 210 toward the wave-directing members 208. In line with the description above, the array 210 section of the waveguide channels may be referred to herein as wave-dividing channels.

As the portions of the electromagnetic waves reach the wave-directing members 208 at the first end 206 of each elongated segment 204 of the waveguide channels 202, the wave-directing members 208 may propagate respective sub-portions of the electromagnetic waves to a second half of the waveguide channels (i.e., in the +z direction, as shown). For instance, the electromagnetic waves may first reach a wave-directing member that is recessed, or machined further into the first metal layer 200 (i.e., a pocket). That recessed member may be configured to propagate a smaller fraction of the electromagnetic waves than each of the subsequent members further down the first end 206, which may be protruding members rather than recessed members. Further, each subsequent member may be configured to propagate a greater fraction of the electromagnetic waves travelling down that particular elongated segment 204 at the first end 206 than the member that came before it. As such, the member at the far end of the first end 206 may be configured to propagate the highest fraction of electromagnetic waves. Each wave-directing member 208 may take various shapes with various dimensions. In other examples, more than one member (or no members) may be recessed. Still other examples are possible as well. In addition, varying quantities of elongated segments are possible.

At block 106, the method 100 includes forming, in a second metal layer, a second half of the one or more waveguide channels, where respective portions of the second half of the one or more waveguide channels include an elongated segment substantially aligned with the elongated segment of the first half of the one or more waveguide channels and, at an end of the elongated segment, at least one pair of through-holes partially aligned with the at least one wave-directing member and configured to radiate electromagnetic waves propagated from the at least one wave-directing member out of the second metal layer.

Within examples, the elongated segment of the second half may be considered to substantially align with the elongated segment of the first half when the two segments are within a threshold distance, or when centers of the segments are within a threshold distance. For instance, if the centers of the two segments are within about ±0.051 mm of each other, the segment may be considered to be substantially aligned.

In another example, when the two halves are combined (i.e., when the two metal layers are joined together), edges of the segments may be considered to be substantially aligned if an edge of the first half of a segment and a corresponding edge of the second half of the segment are within about ±0.051 mm of each other.

In still other examples, when joining the two metal layers, one layer may be angled with respect to the other layer such that their sides are not flush with one another. In such other examples, the two metal layers, and thus the two halves of the segments, may be considered to be substantially aligned when this angle offset is less than about 0.5 degrees.

In some embodiments, the at least one pair of through-holes may be perpendicular to the elongated segments of the second half of the one or more waveguide channels. Further, respective pairs of the at least one pair of through-holes may include a first portion and a second portion. As such, a given pair of through-holes may meet at the first portion to form a single channel. That single channel may be configured to receive at least the portion of electromagnetic waves that was propagated by a corresponding wave-directing member and propagate at least a portion of electromagnetic waves to the second portion. Still further, the second portion may include two output ports and may be configured to receive at least the portion of electromagnetic waves from the first portion of the pair of through-holes and propagate at least that portion of electromagnetic waves out of the two output ports.

FIG. 2B illustrates the second metal layer 220 described above in accordance with the method 100. The second metal layer 220 may include a second half of the plurality of waveguide channels 202 of the first metal layer 200 shown in FIG. 2A (i.e., a second half of the input waveguide channel, the wave-dividing channels, and the wave-radiating channels). As shown, the second half of the waveguide channels 202 may take on the general form of the first half of the channels, so as to facilitate proper alignment of the two halves of the channels. The elongated segments of the second half 222 may include second halves of the array of power dividers 224. As described above, electromagnetic waves may travel through the array 224, where they are divided into portions, and the portions then travel (i.e., in the +x direction, as shown) to respective ends 226 of the second halves of the elongated segments 222. Further, an end 226 of a given elongated segment may include multiple pairs of through-holes 228, which may be at least partially aligned with the wave-directing members 208 of the first metal layer 200. More specifically, each pair of through-holes may be at least partially aligned with a corresponding wave-directing member such that when a given sub-portion of electromagnetic waves are propagated from the first metal layer 200 to the second metal layer 220, as described above, those sub-portions are then radiated out of the pair of through-holes (i.e., a pair of output ports) in the −z direction, as shown. Again, the combination of a given wave-directing member and a corresponding pair of output ports may form a DOEWG, as described above.

Moreover, a combination of all the DOEWGs may be referred to herein as a DOEWG array. In antenna theory, when an antenna has a larger radiating aperture (i.e., how much surface area of the antenna radiates, where the surface area includes the DOEWG array) that antenna may have higher gain (dB) and a narrower beam width. As such, in some embodiments, a higher-gain antenna may include more channels (i.e., elongated segments), with more DOEWGs per channel. While the example antenna illustrated in FIGS. 2A and 2B may be suitable for autonomous-vehicle purposes (e.g., six elongated segments, with five DOEWGs per segment), other embodiments may be possible as well, and such other embodiments may be designed/machined for various applications, including, but not limited to, automotive radar.

For instance, in such other embodiments, an antenna may include a minimum of a single DOEWG. With this arrangement, the output ports may radiate energy in all directions (i.e. low gain, wide beam width). Generally, an upper limit of segments/DOEWGs may be determined by a type of metal used for the first and second metal layers. For example, metal that has a high resistance may attenuate an electromagnetic wave as that wave travels down a waveguide channel. As such, when a larger, highly-resistive antenna is designed (e.g., more channels, more segments, more DOEWGs, etc.), energy that is injected into the antenna via the input port may be attenuated to an extent where not much energy is radiated out of the antenna. Therefore, in order to design a larger antenna, less resistive (and more conductive) metals may be used for the first and second metal layers. For instance, in embodiments described herein, at least one of the first and second metal layers may be aluminum. Further, in other embodiments, at least one of the first and second metal layers may be copper, silver, or another conductive material. Further, aluminum metal layers may be plated with copper, silver, or other low-resistance/high-conductivity materials to increase antenna performance. Other examples are possible as well.

At block 108, the method 100 includes providing at least one fastener configured to join the first metal layer to the second metal layer so as to align the first half of the one or more waveguide channels with the second half of the one or more waveguide channels to form the one or more waveguide channels (i.e., align the first half of the plurality of wave-dividing channels with the second half of the plurality of wave-dividing channels, and align the first half of the plurality of wave-radiating channels with the second half of the plurality of wave-radiating channels). To facilitate this in some embodiments, the method 100 may further involve forming, in the first metal layer, a first plurality of through-holes (not shown in FIG. 2A) configured to house the at least one fastener. Additionally, the method 100 may involve forming, in the second metal layer, a second plurality of through-holes (not shown in FIG. 2B) substantially aligned with the first plurality of through-holes and configured to house the at least one fastener for joining the second metal layer to the first metal layer. In such embodiments, the at least one fastener may be provided into the aligned first and second pluralities of through-holes and secured in a manner such that the two metal layers are joined together.

In some examples, the at least one fastener may be multiple fasteners. Mechanical fasteners (and technology used to facilitate fastening) such as screws and alignment pins may be used to join (e.g., screw) the two metal layers together. Further, in some examples, the two metal layers may be joined directly to each other, with no adhesive layer in between. Still further, the two metal layers may be joined together using methods different than adhesion, diffusion bonding, soldering, brazing, and the like. However, it is possible that, in other examples, such methods may be used in addition to or alternative to any methods for joining metal layers that are known or not yet known.

In some embodiments, one or more blind-holes may be formed into the first metal layer and/or into the second metal layer in addition to or alternative to the plurality of through-holes of the first and/or the second metal layer. In such embodiments, the one or more blind-holes may be used for fastening (e.g., housing screws or alignment pins) or may be used for other purposes.

Figure 2C:
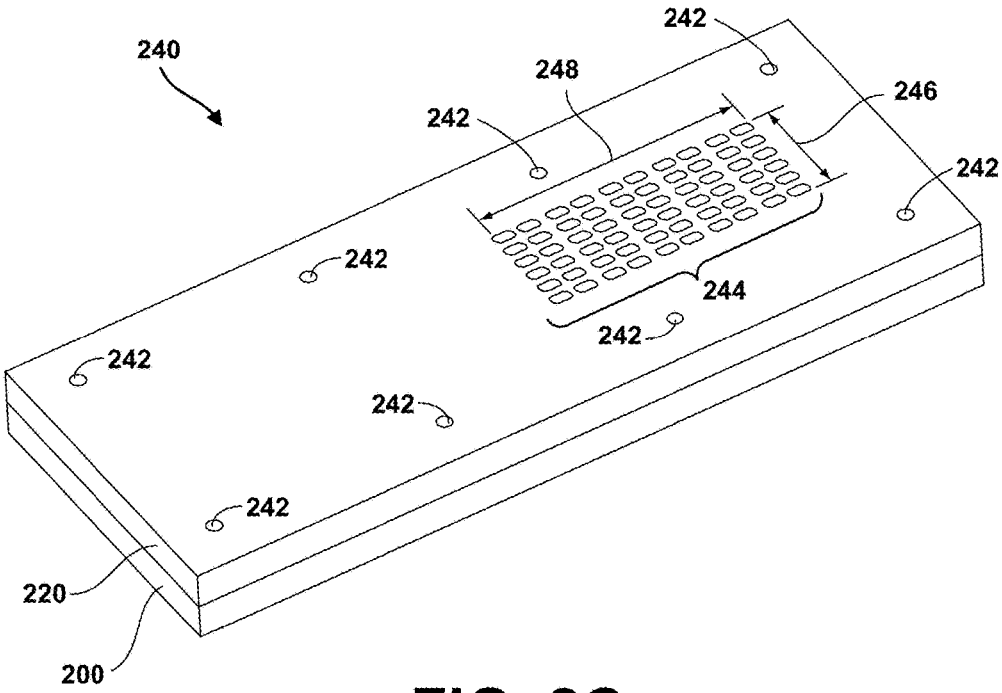
FIGS. 2C and 2D illustrate assembled views of an example antenna, in accordance with an example embodiment.

FIG. 2C illustrates an assembled view of an example antenna 240. The example antenna 240 may include the first metal layer 200 and the second metal layer 220. The second metal layer 220 may include a plurality of holes 242 (through-holes and/or blind-holes) configured to house alignment pins, screws, and the like. The first metal layer 200 may include a plurality of holes as well (not shown) that are aligned with the holes 242 of the second metal layer 220.

Further, FIG. 2C illustrates a DOEWG array 244 of a given width 246 and a given length 248, which may vary based on the number of DOEWGs and channels of the antenna 240. For instance, in an example embodiment, the DOEWG array may have a width of about 11.43 mm and a length of about 28.24 mm. Further, in such an example embodiment, these dimensions, in addition to or alternative to other dimensions of the example antenna 240, may be machined with no less than about a 0.51 mm error, though in other embodiments, more or less of an error may be required. Other dimensions of the DOEWG array are possible as well.

In some embodiments, the first and second metal layers 200, 220 may be machined from aluminum plates (e.g., about 6.35 mm stock). In such embodiments, the first metal layer 200 may be at least 3 mm in thickness (e.g., about 5.84 mm to 6.86 mm). Further, the second metal layer 220 may be machined from a 6.35 mm stock to a thickness of about 3.886 mm. Other thicknesses are possible as well.

In some embodiments, the joining of the two metal layers 200, 220 may result in an air gap or other discontinuity between mating surfaces of the two layers. In such embodiments, this gap or continuity should be proximate to (or perhaps as close as possible to) a center of the length of the antenna apparatus and should have a size of about 0.05 mm or smaller.

Figure 2D:
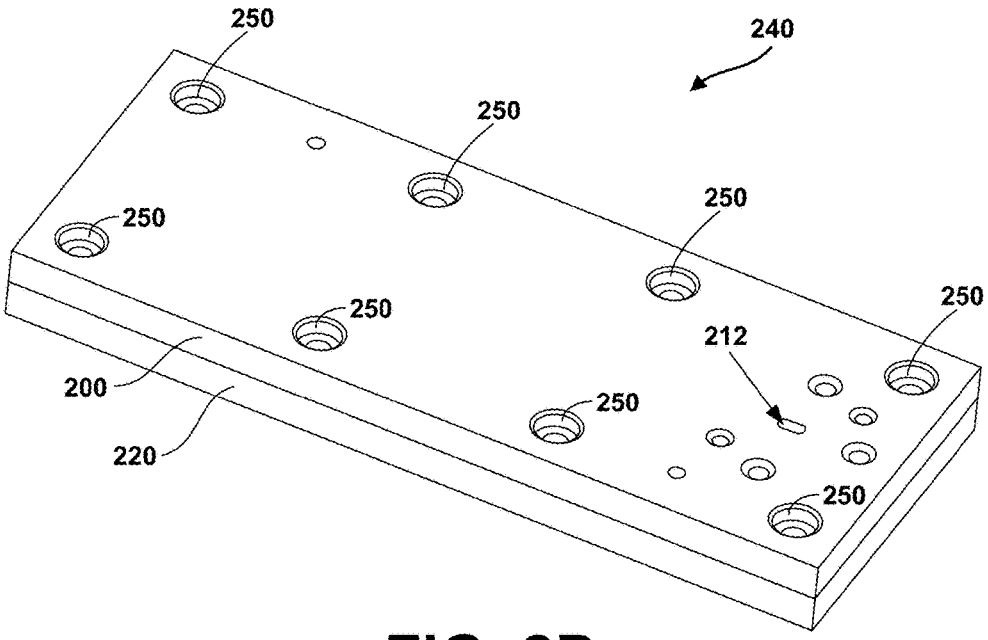

FIG. 2D illustrates another assembled view of the example antenna 240. As shown, the first metal layer 200 may include a plurality of holes 250 (through-holes and/or blind-holes) configured to house alignment pins, screws, and the like. One or more of the plurality of holes 250 may be aligned with the holes 242 of the second metal layer 220. Further, FIG. 2D shows the input port 212, where the antenna 240 may receive electromagnetic waves into the one or more waveguide channels 202.

Figure 2E:
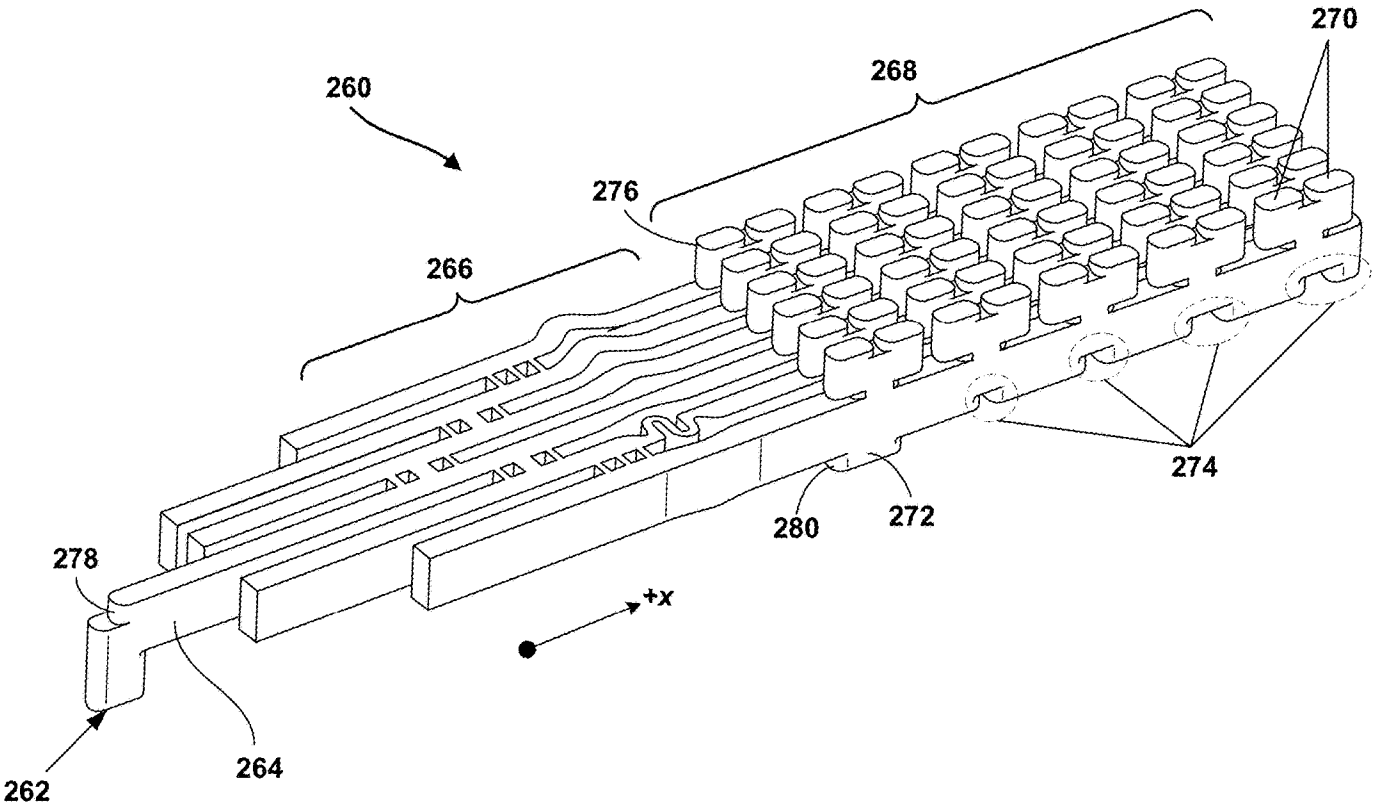
FIG. 2E illustrates conceptual waveguide channels formed inside an assembled example antenna, in accordance with an example embodiment.

FIG. 2E illustrates conceptual waveguide channels 260 formed inside an assembled example antenna. More particularly, the waveguide channels 260 take the form of the waveguide channels 202 of FIGS. 2A and 2B. For instance, the channels 260 include an input port 262 to the input waveguide channel 264. The channels 260 also include wave-dividing channels 266 and wave-radiating channels 268 (i.e., a DOEWG array). As described above, when electromagnetic waves enter the channels 260 at the input port 262, they may travel in the +x direction through the input waveguide channel 264 and be divided into portions by the wave-dividing channels 266 (e.g., by the power dividers). Those portions of electromagnetic waves may then travel in the +x direction to respective wave-radiating channels 268, where sub-portions of those portions are radiated out each DOEWG through pairs of output ports, such as pair 270, for instance.

In a particular wave-radiating channel, a portion of electromagnetic waves may first be propagated through a first DOEWG with a recessed wave-directing member 272 (i.e., an inverse step, or "well"), as discussed above. This recessed wave-directing member 272 may be configured to radiate the smallest fraction of energy of all the members of the DOEWGs of the particular wave-radiating channel. Subsequent wave-directing members 274 may be formed (e.g., protruded, rather than recessed) such that each subsequent DOEWG can radiate a higher fraction of the remaining energy than the DOEWG that came before it. Phrased another way, each wave-directing member 272, 274 may generally be formed as a "step cut" into a horizontal (+x direction) channel (i.e., a wave-radiating channel, or the "first end" of an "elongated segment" as noted above) and used by the antenna to tune the amount of energy that is radiated vs. the amount of energy that is transmitted further down the antenna.

In some embodiments, a given DOEWG may not be able to radiate more than a threshold level of energy and may not be able to radiate less than a threshold level of energy. These thresholds may vary based on the dimensions of the DOEWG components (e.g., the wave-directing member, a horizontal channel, a vertical channel, a bridge between the two output ports, etc.), or may vary based on other factors associated with the antenna.

In some embodiments, the first and second metal layers may be machined such that various sides of the waveguide channels 260 have rounded edges, such as edge 276, 278, and 280, for example.

Figure 3A:
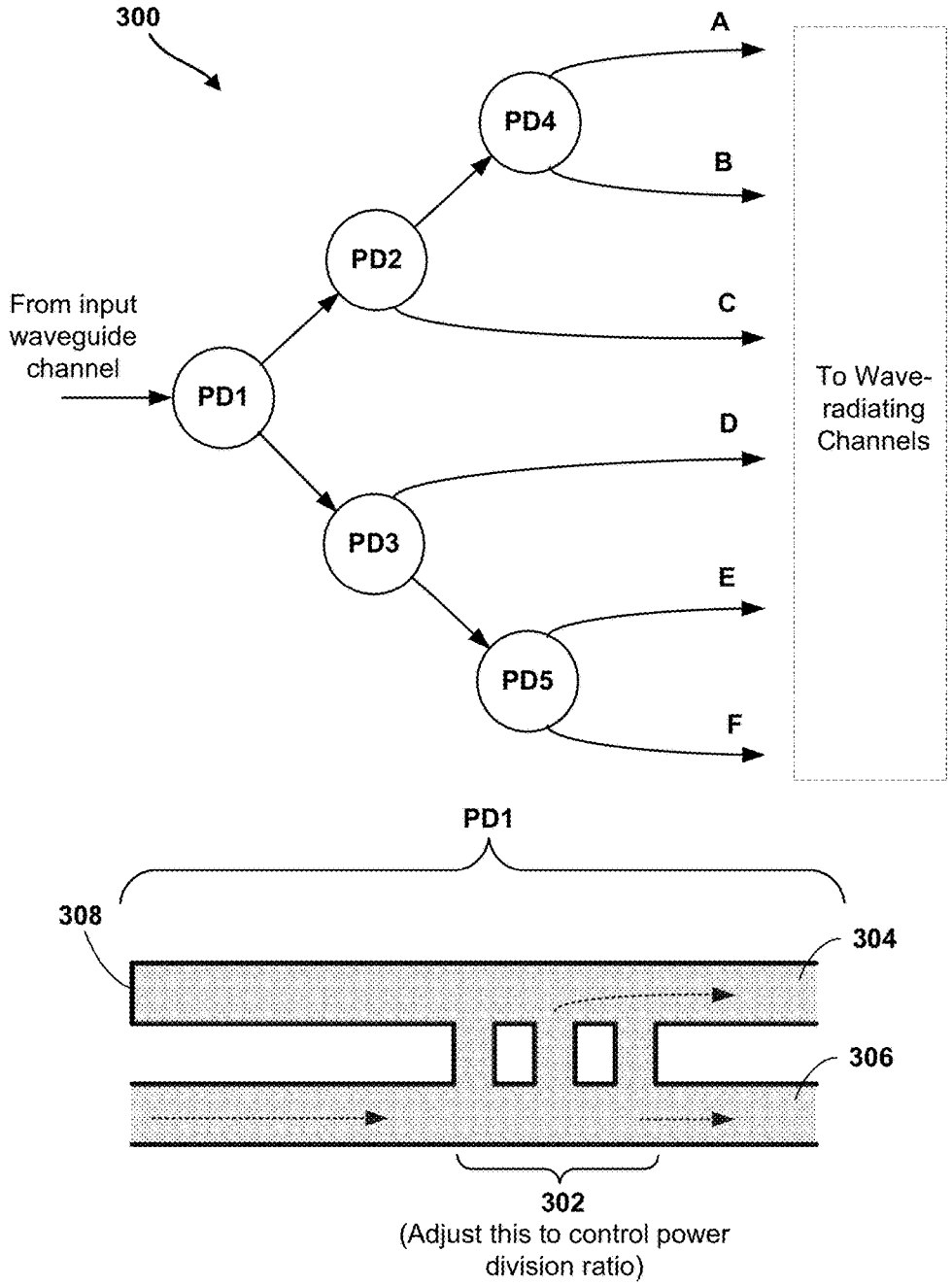
FIG. 3A illustrates a network of wave-dividing channels of an example antenna, in accordance with an example embodiment.
Figure 3B:
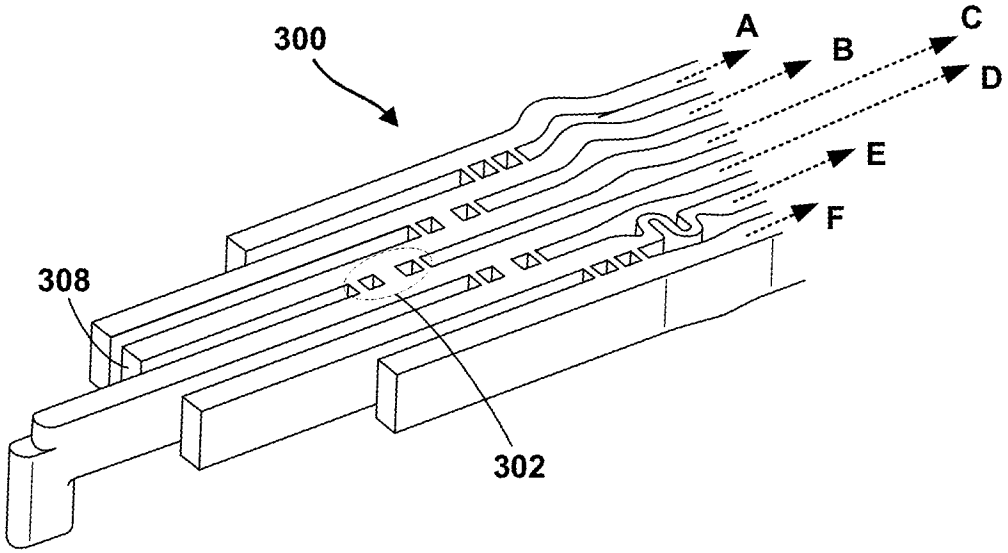
FIG. 3B illustrates an alternate view of the network of wave-dividing channels of FIG. 3A, in accordance with an example embodiment.

FIG. 3A illustrates a network of wave-dividing channels 300 of an example antenna, in accordance with an example embodiment. And FIG. 3B illustrates an alternate view of the network of wave-dividing channels 300, in accordance with an example embodiment.

In some embodiments, the network (e.g., beam-forming network, as noted above) of wave-dividing channels 300 may take the form of a tree of power dividers, as shown in FIG. 3A. Energy may enter the antenna through the input waveguide channel and is divided (i.e., split) into smaller portions of energy at each power divider, such as power divider 302, and may be divided multiple times via subsequent power dividers so that a respective amount of energy is fed into each of the wave-radiating channels (energy A-F, as shown). The amount of energy that is divided at a given power divider may be controlled by a power division ratio (i.e., how much energy goes into one channel 304 versus how much energy goes into another channel 306 after the division). A given power division ratio may be adjusted based on the dimensions of the corresponding power divider. Further, each power divider and associated power division ratio may be designed/calculated in order to achieve a desired "power taper" at the wave-radiating channels. In such a case, the antenna may be designed with a "Taylor window" (e.g., radiation ripples drop off at edges) or other window such that sidelobes of the antenna's far-field radiation pattern may be low. As an example, the power division ratios of the power dividers may be set such that energy portions A, B, C, D, E, and F are approximately 3.2%, 15.1%, 31.7%, 31.7%, 15.1%, 3.2% of the energy, respectively. Other example power divisions are possible as well.

Within examples, a technique for dividing energy between two channels 304, 306 may be to use a structure of channels (i.e., a "four-port branchline coupler) such as that shown at the bottom of FIG. 3A. Such a technique and structure design may include a "terminator" 308 at the end of a channel, as shown in FIGS. 3A and 3B, where small wedges of radio frequency-absorbing material may be located to absorb energy that returns backwards through the channel to that terminator 308.

Figure 4A:
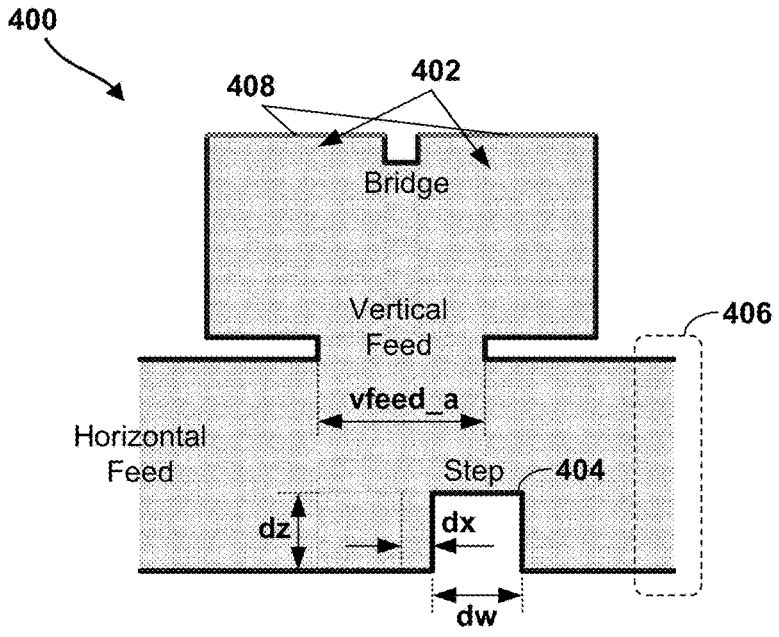
FIG. 4A illustrates an example wave-radiating portion of an example antenna, in accordance with an example embodiment.

FIG. 4A illustrates an example wave-radiating portion of an example antenna, in accordance with an example embodiment. More specifically, FIG. 4A illustrates a cross-section of an example DOEWG 400. As noted above, a DOEWG 400 may include a horizontal feed (i.e., channel), a vertical feed, and a wave-directing member 404. The vertical feed may split into two parts, and each parts of the vertical feed may include an output port 402 configured to radiate at least a portion of electromagnetic waves out of the DOEWG 400. In some embodiments, the farthest DOEWG from the input port may include a backstop at location 406. DOEWGs that come before the last DOEWG may simply be open at location 406 and electromagnetic waves may propagate through that location 406 to subsequent DOEWGs.

In order to tune a DOEWG such as DOEWG 400, in some examples, a perfect electric conductor (PEC) plane 408 may be attached to the two output ports 402. Further, the vertical feed width, vfeed_a, and various dimensions of the step 404 (e.g., dw, dx, and dz) may be tuned to achieve different fractions of radiated energy out the DOEWG 400 (at the PEC plane 408).

Figure 4B:
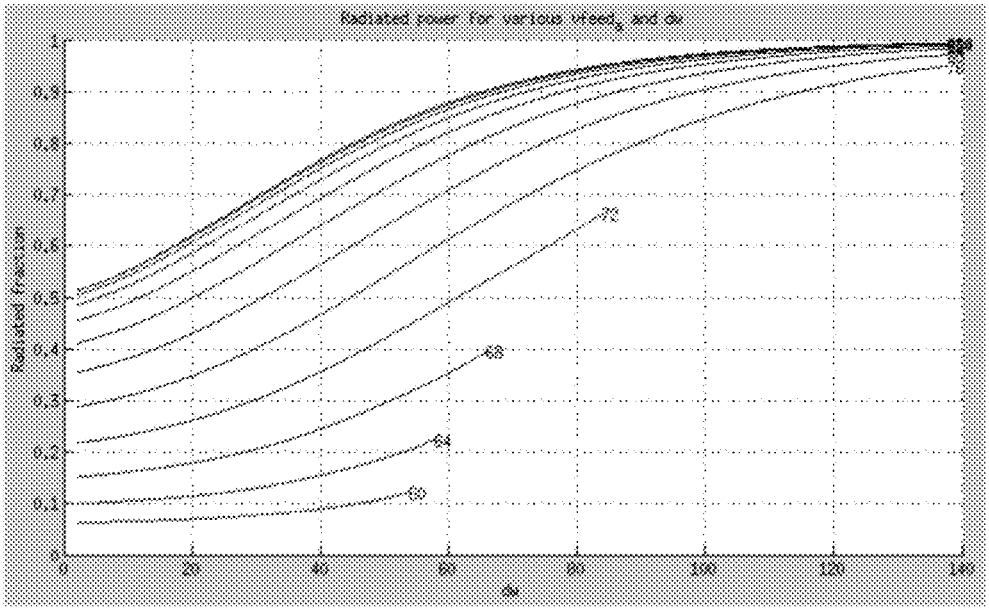
FIGS. 4B-4D are example graphs associated with tuning or operation of an example antenna, in accordance with an example embodiment.
Figure 4C:
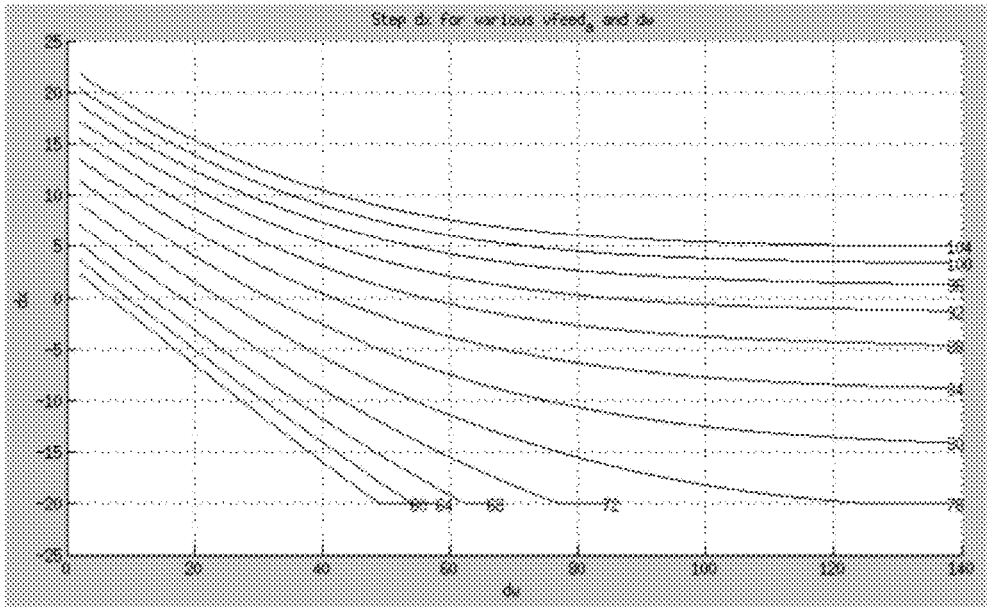
Figure 4D:
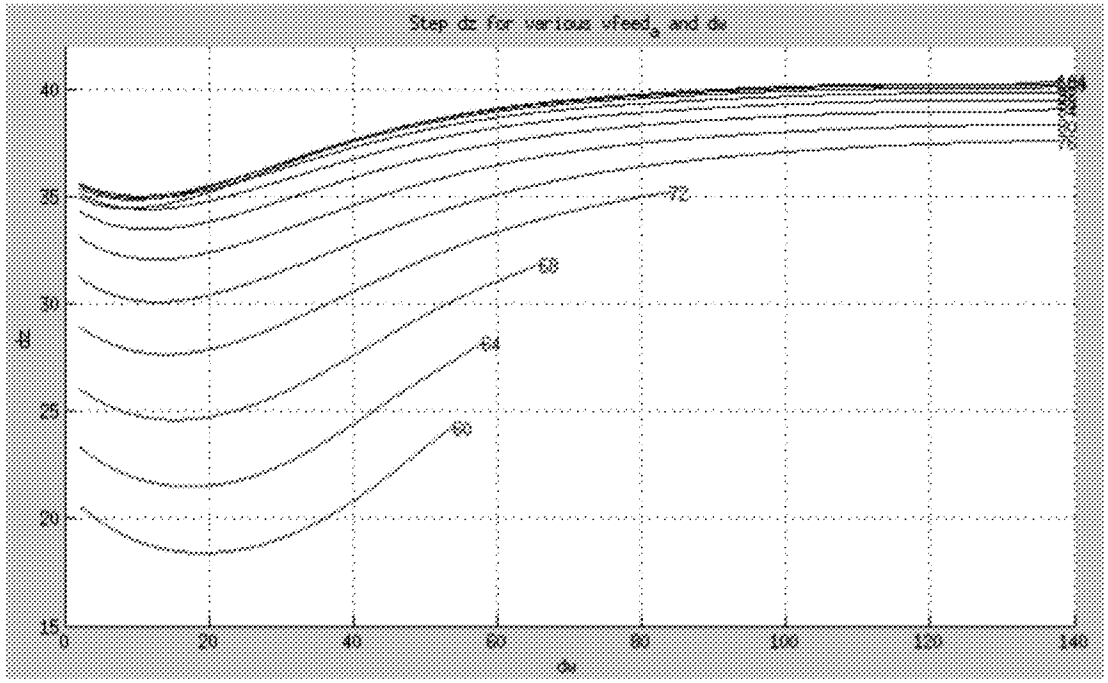
Figure 4E:
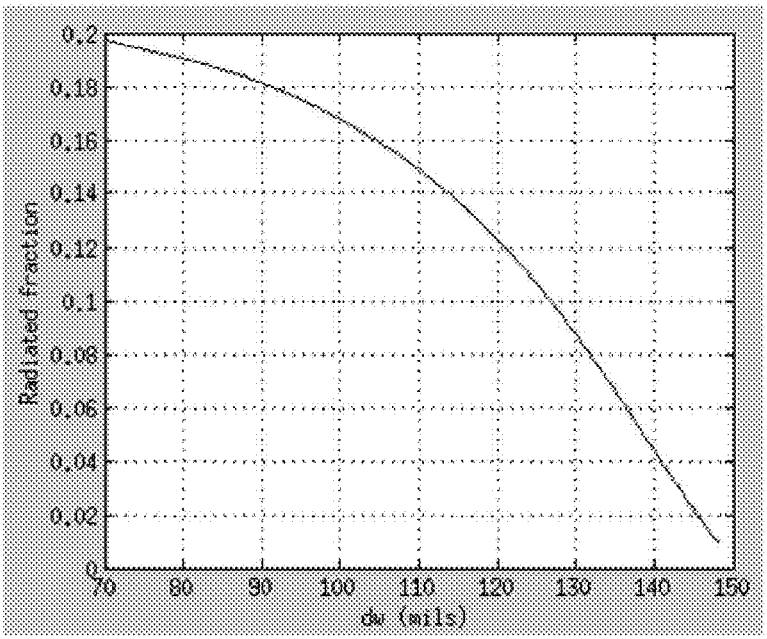
FIGS. 4E and 4F are other example graphs associated with tuning or operation of an example antenna, in accordance with an example embodiment.
Figure 4F:
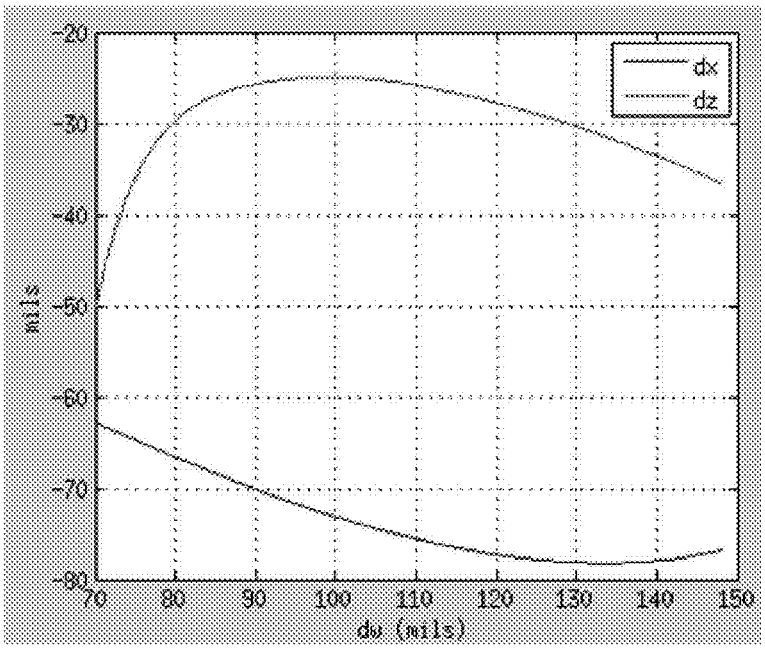

As such, FIGS. 4B-4D are various tuning curves associated with operation of an example protruding wave-directing member (i.e., a positive step 404). In the graphs shown, dw, dx and dz are in mils (thousandths of an inch). Each curve may be a sixth order polynomial with varying coefficients, though other data fitting processes are possible as well in other examples. The return loss in such curves may be less than −30 dB. In order to achieve a fraction of radiated energy lower than about 20%, a recessed wave-directing member (i.e., a negative step) may be used instead of the protruding wave-directing member shown in FIG. 4A. As such, FIGS. 4E and 4F are tuning curves associated with operation of an example recessed wave-directing member. For these curves, vfeed_a may equal 90.

Within examples, the data curves of FIGS. 4A-4F, which illustrate antenna data associated with different combinations of DOEWG dimensions and measure returned loss and radiated power fractions, may be used to facilitate more efficient design of a DOEWG. For instance, a desired radiated power fraction (from the power taper, as discussed above) and desired vfeed_a may first be selected. Then, associations between dw, dx, and dz can be determined by referring to example data such as that in FIG. 4A and those in either FIGS. 4B-4D (for protruding members) or FIGS. 4E-4F (for recessed members). As a result, the determined values for dw, dx, and dz may be used for a DOEWG to achieve the desired radiated power fraction as well as a minimal return loss.

It should be understood that other shapes and dimensions of the waveguide channels, portions of the waveguide channels, sides of the waveguide channels, wave-directing members, and the like are possible as well. In some embodiments, a rectangular shape of waveguide channels may be highly convenient to manufacture, though other methods known or not yet known may be implemented to manufacture waveguide channels with equal or even greater convenience.

It should be understood that arrangements described herein are for purposes of example only. As such, those skilled in the art will appreciate that other arrangements and other elements (e.g. machines, apparatuses, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the scope being indicated by the following claims.

What is claimed is:

1. An apparatus for a dual open-ended waveguide antenna, the apparatus comprising:

a first layer including a first half of a waveguide channel, wherein the first half of the waveguide channel includes an elongated segment and, at a first end of the elongated segment, one or more wave-directing members, wherein the first layer further includes a through-hole at a second end of the elongated segment opposite the first end of the elongated segment, the through-hole being configured to receive electromagnetic waves into the waveguide channel; and a second layer joined to the first layer, the second layer including a second half of the waveguide channel joined to the first layer to align the first half of the waveguide channel with the second half of the waveguide channel to form the waveguide channel, wherein the second half of the waveguide channel includes an elongated segment aligned with the elongated segment of the first half of the waveguide channel and further includes, at an end of the elongated segment, at least one radiating element configured to radiate electromagnetic waves propagated from the one or more wave-directing members out of the second layer, and wherein each of the one or more wave-directing members are configured to propagate a predetermined respective portion of the electromagnetic waves into the second layer for radiation out of the second layer.

2. The apparatus of claim 1, wherein the waveguide channel includes one or more power-dividing elements, each having respective dimensions associated with a respective predetermined power taper profile, and each being configured to divide at least a portion of the electromagnetic waves according to the respective predetermined power taper profile into multiple portions within the waveguide channel.

3. The apparatus of claim 1, wherein the one or more wave-directing members include one or more recessed members recessed in a direction away from the second layer and further include one or more protruded members protruding in a direction towards the second layer.

4. The apparatus of claim 3, wherein the one or more recessed members are configured to propagate a first portion of the electromagnetic waves into the second layer for radiation out of the second layer, wherein the one or more protruded members are configured to propagate a second portion of the electromagnetic waves into the second layer for radiation out of the second layer, and wherein the first portion is less than the second portion.

5. The apparatus of claim 1, wherein the electromagnetic waves include electromagnetic waves at a frequency of about 77 gigahertz.

6. The apparatus of claim 1, wherein each radiating element of the at least one radiating element includes a first portion and a second portion, wherein the first portion of the radiating element includes a single channel configured to receive the respective portion of the electromagnetic waves propagated by a corresponding wave-directing member of the one or more wave-directing members and propagate the respective portion of the electromagnetic waves into the second portion of the radiating element, and wherein the second portion of the radiating element includes two output ports and is configured to receive the respective portion of the electromagnetic waves from the first portion of the radiating element and propagate the respective portion of the electromagnetic waves out of the two output ports.

7. The apparatus of claim 1, wherein the first layer and the second layer are each comprised of a metal, the metal including one or more of aluminum, copper, and silver.

8. The apparatus of claim 1, wherein the first layer further includes a first plurality of through-holes configured to house fasteners for joining the second layer to the first layer, wherein the second layer further includes a second plurality of through-holes aligned with the first plurality of through-holes and configured to house the fasteners for joining the second layer to the first layer, and wherein the second layer is joined to the first layer with the fasteners such that the second half of the waveguide channel is aligned with the first half of the waveguide channel.

9. The apparatus of claim 8, wherein the fasteners include alignment pins and screws.

10. A method, comprising:

forming, in a first layer, a first half of a waveguide channel, wherein the first half of the waveguide channel includes an elongated segment and, at a first end of the elongated segment, one or more wave-directing members, wherein the first layer further includes a through-hole at a second end of the elongated segment opposite the first end of the elongated segment, the through-hole being configured to receive electromagnetic waves into the waveguide channel;

forming, in a second layer, a second half of the waveguide channel, wherein the second half of the waveguide channel includes an elongated segment and, at an end of the elongated segment, at least one radiating element configured to radiate electromagnetic waves propagated from the one or more wave-directing members out of the second layer, and wherein each of the one or more wave-directing members are configured to propagate a predetermined respective portion of the electromagnetic waves into the second layer for radiation out of the second layer; and joining the first layer to the second layer to align the first half of the waveguide channel with the second half of the waveguide channel to form the waveguide channel and to align the elongated segment of the second half of the waveguide channel with the elongated segment of the first half of the waveguide channel.

11. The method of claim 10, further comprising:

forming, in the first layer, a first plurality of through-holes configured to house at least one fastener for joining the second layer to the first layer; and forming, in the second layer, a second plurality of through-holes to be aligned with the first plurality of through-holes and configured to house the at least one fastener, wherein joining the first layer to the second layer comprises providing the at least one fastener in the first plurality of through-holes and in the second plurality of through-holes.

12. The method of claim 10, wherein the one or more wave-directing members includes multiple collinear wave-directing members, and wherein the at least one radiating element includes multiple pairs of through-holes partially aligned with the collinear wave-directing members.

13. The method of claim 10, wherein each radiating element of the at least one radiating element includes a first portion and a second portion, wherein the first portion of the radiating element includes a single channel configured to receive the respective portion of the electromagnetic waves propagated by a corresponding wave-directing member of the one or more wave-directing members and propagate the respective portion of the electromagnetic waves into the second portion of the radiating element, and wherein the second portion of the radiating element includes two output ports and is configured to receive the respective portion of the electromagnetic waves from the first portion of the radiating element and propagate the respective portion of the electromagnetic waves out of the two output ports.

14. The method of claim 10, wherein the electromagnetic waves include electromagnetic waves at a frequency of about 77 gigahertz.

15. The method of claim 10, wherein the waveguide channel includes one or more power-dividing elements, each having respective dimensions associated with a respective predetermined power taper profile, and each being configured to divide at least a portion of the electromagnetic waves according to the respective predetermined power taper profile into multiple portions within the waveguide channel.

16. An apparatus, comprising:

a first layer including a first half of a waveguide channel, the first half of the waveguide channel including (i) an input port configured to receive electromagnetic waves into the waveguide channel, (ii) a plurality of wave-directing members, (iii) a plurality of wave-dividing sub-channels configured to receive the electromagnetic waves from the input port, divide the electromagnetic waves into a plurality of predetermined portions, and propagate the plurality of predetermined portions to the plurality of wave-directing members; and a second layer joined to the first layer and including a second half of the waveguide channel, the second half of the waveguide channel including a plurality of radiating elements partially aligned with the plurality of wave-directing members and configured to receive the plurality of predetermined portions of the electromagnetic waves from the plurality of wave-directing members and further configured to radiate the plurality of predetermined portions out of the second layer, wherein the plurality of wave-directing members are configured to receive the plurality of predetermined portions of the electromagnetic waves from the plurality of wave-dividing sub-channels and propagate predetermined sub-portions of the electromagnetic waves into the second layer for radiation out of the second layer.

17. The apparatus of claim 16, wherein the second layer is joined to the first layer with a plurality of fasteners including one or more of: at least one alignment pin and at least one screw.

18. The apparatus of claim 16, wherein the plurality of wave-dividing sub-channels includes one or more power-dividing elements, each having respective dimensions associated with a respective predetermined power taper profile, and each being configured to divide at least a portion of the electromagnetic waves into the plurality of predetermined portions according to the respective predetermined power taper profile.

19. The apparatus of claim 16, wherein the first layer and the second layer are each comprised of a metal, the metal including one or more of aluminum, copper, and silver.

20. The apparatus of claim 16, wherein the plurality of wave-directing members includes multiple collinear wave-directing members of respective different sizes, wherein the plurality of radiating elements include at least one pair of output ports partially aligned with the plurality of wave-directing members, wherein the plurality of wave-directing members include a recessed member configured to propagate a first sub-portion of the electromagnetic waves into the second layer and at least one protruded member configured to propagate subsequent sub-portions of the electromagnetic waves into the second layer, and wherein the first sub-portion is less than the subsequent sub-portions.

* * * * *